US005429270A

United States Patent [19]

Tumminia

[11] Patent Number: 5,429,270

[45] Date of Patent: Jul. 4, 1995

[54] PROCESS AND APPARATUS FOR DISPENSING LIQUIDS TO A REMOTE BATHROOM FIXTURE

[76] Inventor: Ronald Tumminia, 111 Calico Rd., Lake Mary, Fla. 32746

[21] Appl. No.: 304,164

[22] Filed: Sep. 12, 1994

[51] Int. Cl.[6] ..... B67B 7/00

[52] U.S. Cl. ..... 222/1; 222/67; 222/333; 222/642; 4/227.2

[58] Field of Search ..... 222/63, 64, 67, 129, 222/333, 325, 642, 643, 1; 4/227.1, 227.2, 227.4

[56] References Cited

U.S. PATENT DOCUMENTS

| | | | |
|---|---|---|---|
| 703,287 | 6/1902 | Martin . | |
| 939,424 | 11/1909 | Kneen . | |
| 1,007,442 | 10/1911 | Hahesy . | |
| 1,883,139 | 10/1932 | Walter | 222/64 X |
| 1,950,139 | 3/1934 | French . | |
| 2,144,465 | 1/1939 | Selleck | 222/643 |
| 2,351,580 | 6/1944 | Beckman | 4/227.4 X |
| 2,644,167 | 7/1953 | Gordon . | |
| 3,241,718 | 3/1966 | Kemper . | |
| 4,429,809 | 2/1984 | Bousgarbies | 222/67 |
| 4,512,041 | 4/1985 | Tsai | 4/227 |
| 4,696,414 | 9/1987 | Huat | 222/67 |
| 4,728,005 | 3/1988 | Jacobs et al. | 222/64 |
| 4,796,787 | 1/1989 | Tsuyuki | 222/64 |
| 4,915,260 | 4/1990 | Jones | 222/1 |

FOREIGN PATENT DOCUMENTS

| | | | |
|---|---|---|---|
| 0018648 | 11/1980 | European Pat. Off. | 4/227.2 |

*Primary Examiner*—Gregory L. Huson
*Attorney, Agent, or Firm*—William M. Hobby, III

[57] ABSTRACT

A liquid dispenser system for dispensing a cleaning liquid to a remote bathroom fixture includes a bathroom wall having a storage unit mounted in the wall and having an access cover or door covering the storage area and a liquid storage container located therein. An electric pump is located in the wall storage unit and is operatively connected to the liquid container for pumping the cleaning liquid through a conduit connected from the pump to a bathroom fixture for delivering a cleaning liquid to the fixture. A pump actuating switch is electrically connected to the pump and to a timer and to the end of the conduit for actuating the pump remotely to thereby pump liquid from the liquid storage container to the remote fixture. A method is provided which includes attaching a wall storage unit in a bathroom wall and placing a storage container therein behind an access cover. The liquid storage container is connected to an electric pump located in the wall storage area for pumping the liquid from the container. A conduit is connected from the pump through a bathroom wall to a bathroom fixture for delivering liquid from the storage container to the bathroom fixture. A pump actuated magnetic float switch is mounted adjacent the bathroom fixture, and is connected through a conductor to the pump for actuating the pump remotely responsive to the movement of the liquid in the bathroom fixture.

14 Claims, 1 Drawing Sheet

PROCESS AND APPARATUS FOR DISPENSING LIQUIDS TO A REMOTE BATHROOM FIXTURE

BACKGROUND OF THE INVENTION

The present invention relates to a liquid dispenser system and especially to a bathroom liquid dispenser system for dispensing a cleaning liquid remotely stored in a wall to a bathroom fixture.

In the past, it has been common to provide cleaning liquids or fluids in a water closet or toilet tank. The cleaning fluids enter the water in the tank and are then flushed into the toilet bowl when the toilet is flushed. This is commonly done by placing a cleaning agent in a solid form in the toilet tank where it dissolves in the water in the toilet tank at a slot rate. The material placed in the toilet tank will last for a short period of time constantly dissolving small amounts into the water within the toilet tank which is then flushed into the toilet bowl. This type of toilet bowl cleaner has limited effectiveness in that the amount of cleaner dissolved within the water is variable depending on the water and how often the toilet is flushed to remove and replace the water in the tank. Thus, hard water or water with considerable minerals therein tends to have a reduced ability to dissolve the solid structure of the cleaning agent while softer water tends to dissolve greater amounts of the cleaning solid.

It has also been suggested in a number of prior art patents to have liquid dispensers for dispensing liquid cleaning agents into a toilet tank and from the toilet tank into the toilet bowl and also directly into the toilet bowl. Such prior art U.S. patents can be seen in the Jones patent, U.S. Pat. No. 4,915,260, for a Float Control Dispenser, in which the rising and falling of the water level in the toilet tank raises the float to mechanically release a predetermined amount of cleaning agent into the toilet tank with each flush. Similarly, the Tsai patent, U.S. Pat. No. 4,512,041, is a Dispensing Device for toilets which include a supply container of liquid cleanser which is dispensed during each flushing cycle. The unit is attached to the inside of a toilet tank. The Gordon patent, U.S. Pat. No. 2,644,167, is a Disinfectant Dispenser for the water tank of a water closet in which the rising and falling of a float dispenses the liquid from inside the toilet tank. The French patent No. 1,950,139 is similarly placed inside the toilet tank for dispensing disinfectants within the tank and into the toilet bowl. The flushing handle that actuates the flushing mechanism is connected to simultaneously actuate the dispensing of the liquid from a storage container located within the toilet tank. The Kemper patent, U.S. Pat. No. 3,241,718, is a Liquid Dispenser also placed within a toilet tank and which is actuated by a float each time the toilet is flushed to dispense predetermined amounts of disinfectant within the toilet tank.

The Kneen U.S. Pat. No. 939,424 shows a Valve for a Water Closet Disinfecting Device in which the storage container is placed on top of the toilet tank with a dispensing valve which is nudged to release the disinfectant when the flushing handle is actuated. In the Martin patent, U.S. Pat. No. 703,287 a Device for Automatically Distributing Disinfecting Fluids has the storage container placed above the toilet tank and is mechanically actuated to move a dispensing spout to dispense the fluid. The Hahesy patent, U.S. Pat. No. 1,007,442, also teaches an Automatic Disinfecting Device in which the storage tank is attached to the wall adjacent the water closet water tank and mechanically dispenses a fluid responsive to a float valve having an extension stem operative upon changing of the water level.

In contrast to these prior art patents, the present invention is directed towards a liquid dispenser for dispensing cleaning or disinfecting agents into a toilet tank and in which a storage container is mounted inside the wall along with an electric pump so that much larger amounts of liquid cleaner can be stored and dispensed over a longer period of time. The use of unattractive storage tanks mounted to the side of a wall and of limited space storage tanks and dispensers mounted within the toilet tank is eliminated. The access panel is disguised with a mirror and a much more accurate dispensing of the cleaning fluid is achieved with an electrically actuated pump operated through a timer for a predetermined time period.

SUMMARY OF THE INVENTION

A liquid dispenser system for dispensing a cleaning liquid to a remote bathroom fixture includes a bathroom wall having a storage unit mounted in the wall and having an access cover or door covering the storage area and a liquid storage container located therein. An electric pump is located in the wall storage unit and is operatively connected to the liquid container for pumping the cleaning liquid in the container from the container and into a conduit connected from the pump to a bathroom fixture for delivering a cleaning liquid to the fixture. A pump actuating switch is electrically connected to the pump and to a timer and to the end of the conduit for actuating the pump remotely to thereby pump liquid from the liquid storage container to the remote fixture. The pump actuating switch is a float switch having a float with a magnet thereon for actuating a magnetic relay upon the water level dropping in a toilet tank. A method is provided which attaches a wall storage unit in a bathroom wall and places a storage container in the wall storage unit behind an access cover. The liquid storage container is connected to an electric pump located in the wall storage unit for pumping the liquid from the container. A conduit is connected to the pump through a bathroom wall into a bathroom fixture for delivering the liquid from the storage container to the bathroom fixture. The next step is the selecting and positioning of a pump actuated magnetic float switch adjacent the bathroom fixture, and connecting an electrical conductor from the pump actuating switch through the bathroom wall to the electric pump for actuating the pump remotely responsive to the movement of the liquid in the bathroom fixture.

BRIEF DESCRIPTION OF THE DRAWINGS

Other objects, features, and advantages of the present invention will be apparent from the written description and the drawings in which.

DESCRIPTION OF THE PREFERRED EMBODIMENT

Figure 1:
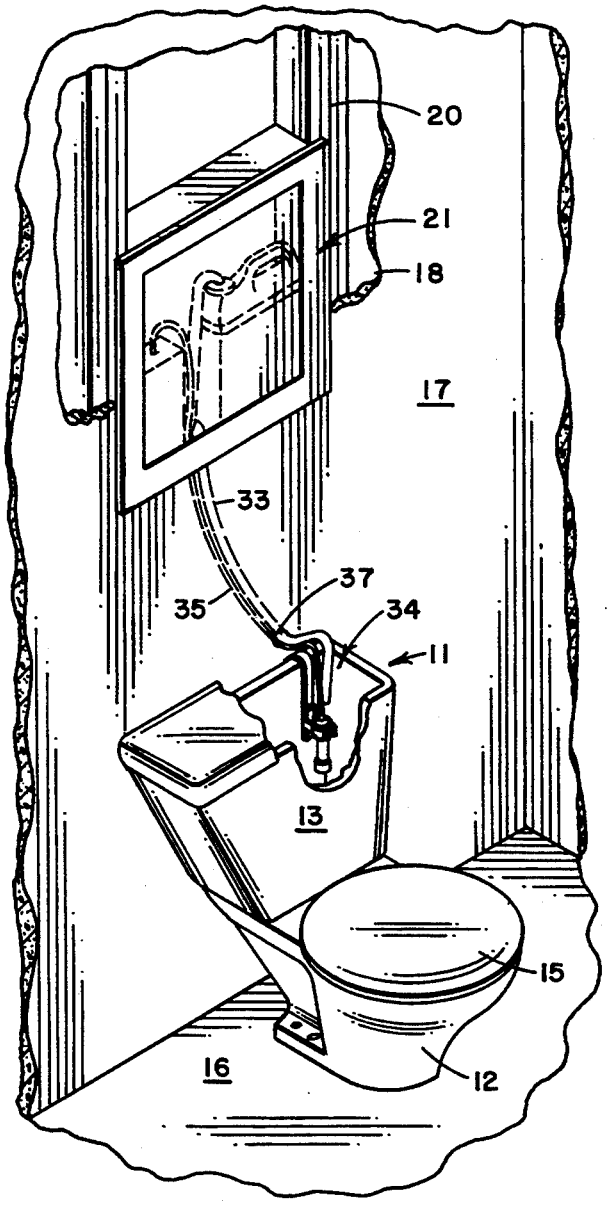
FIG. 1 is a perspective view of a portion of the bathroom having the present invention attached thereto.
Figure 2:
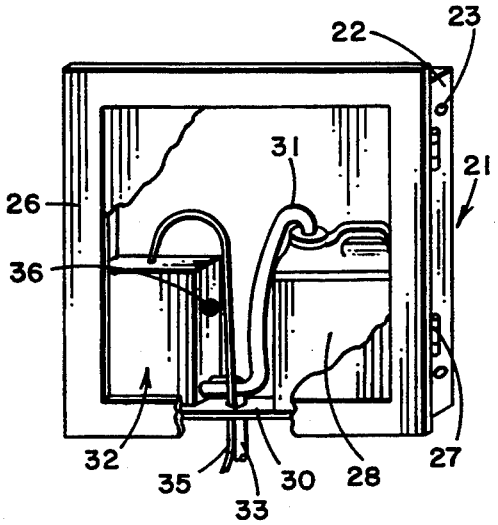
FIG. 2 is a perspective view of the wall storage unit for attaching to the inside of a bathroom wall.

Referring to the drawings and especially to FIG. 1, a bathroom 10 has a toilet 11 mounted therein which has a toilet bowl 12, toilet tank 13 with a toilet tank top 14 and a toilet seat 15. The toilet bowl 12 is attached to the bathroom floor 16 and adjacent a bathroom wall 17. The bathroom wall 17 has a dry wall or other wall covering 18 attached to a plurality of studs 20. A prefabricated wall storage unit 21 has stud attaching side members 22, each having apertures 23 therethrough for attaching a nail or threaded fastener therethrough and into the studs 20. The storage unit has a floor and a hinged cover 24. Hinge cover 24 in the embodiment shown has a mirror 25 with a mirror frame 26 which is hinged with hinges 27. Inside the wall unit 21 is a large liquid storing container 28 for storing either a cleaning liquid or a disinfectant agent. The container 28 is sitting on the floor 30 of the wall unit 21 so that it may be quickly removed and replaced with another storage unit 28. The storage unit 28 has a tube or conduit 31 coming out of the bottom of the container 28 and connecting into the pump and timer unit 32. The pump and timer unit 32 houses a conventional electrical pump commercially available with an interconnected timer for pumping the liquid received from the tube 31 through the tube 33 when actuated by a pump actuating switch 34 remotely located at the fixture 11. The pump and timer 32 may be battery operated or may use any low voltage operated pump and timer. The pump actuating switch 34 is connected through an electrical conductor 35 to actuate the pump for a timed sequence for pumping a predetermined amount of liquid from the container 28.

The pump and timer unit has a primer switch 36 for priming the pump when replacing the liquid storage container 28. The conduit 33 is shown passing through the wall 17 and out an opening 37 in the wall 17 adjacent the toilet tank 13 where it is connected to the pump actuating switch 34. The conductor 35 is passed through the bottom of the wall unit 21 and through the wall 17 and out the opening 37 where it is connected to pump actuating member 34.

Figure 3:
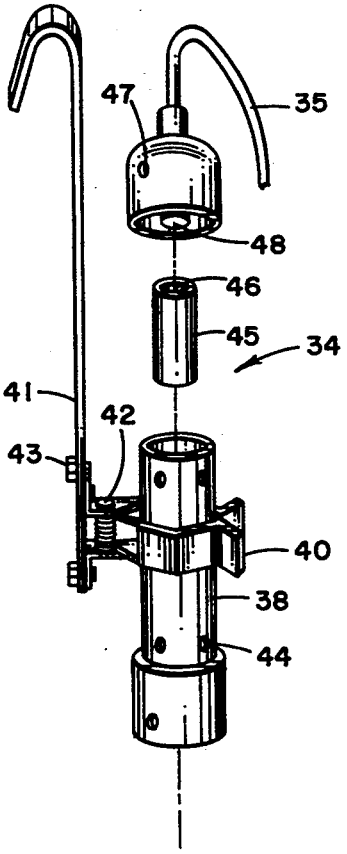
FIG. 3 is an exploded view of a magnetically actuated valve.

Pump actuating switch 34, as more clearly seen in FIG. 3, has a body 38 supported in a clip 40 to a toilet attaching hanger member 41. Clip 40 is spring loaded with the spring 42 which in turn is bolted with the bolts 43 to the hanging attaching member 41. The housing 38 has a plurality of openings 44 therein and is a hollow tubular structure having a cylindrical float 45 which can, for instance, be of a cork material or of a lightweight foamed polymer and has a permanent magnet 46 attached to the top thereof. A removable top portion 47 attaches to the housing 38 and has a magnetic relay 48 mounted therein and connected to the conductors 35 which in turn are connected to the pump and timer unit 32. The pump actuating switch 34 is attached in the toilet bowl 11 with the hanger member 41. The rising of water from within the toilet tank keeps the float 45 raised to put the magnet 46 against the relay 48, which relay remains open whenever the magnet 46 is adjacent thereto to prevent an electrical signal being fed to the pump 32. Upon the water dropping in the toilet tank 11, float 45 drops, removing the magnet 46 away from the magnetic relay 48 to allow the magnetic relay to close, thereby allowing a small electrical voltage to reach the pump and timer 34 to actuate the timer for a timed cycle for operating the pump to pump a predetermined amount of liquid from the container 28 through the dispensing conduit 33 into the toilet tank 13 where it is then flushed into the toilet bowl 12.

The timer can be varied so that the amount of dispensing of the liquid cleaner or the disinfectant can be varied depending upon the amount of water being flushed with each flush from the toilet tank 13. In addition, by having the storage and pump remotely located within the wall of a bathroom, large storage units 28 can be utilized, which units can be rapidly exchanged to replace an empty container 28 with a full container.

The wall unit 21 is advantageously made as a prefabricated unit complete with the timer-pump mounted in it so that during construction, the unit can be slid between a pair of spaced stud members 20 and attached with fasteners through the openings 23 to either side and can already have an access panel or hinged door 24 attached thereto with hinges 27. For a more decorative unit, a mirror 25 can be attached within a frame 26 to the door 24 to allow easy access to the storage unit. Alternatively, the wall portion 18 can be cut away to allow the unit 21 to be inserted and attached to an existing wall.

A method in accordance with the present invention allows for the selection and attachment of the wall storage unit 21 inside a bathroom wall and the placing of a liquid storage container in the wall storage unit 21 and connecting the liquid storage container to a pump and to a remote bathroom fixture 11 by routing the conduit 33 through the wall 17 and out the opening 30 adjacent the bathroom fixture 11. The process also includes the selection and positioning of the pump switch 34 within the toilet tank 13 of the toilet 11 and routing an electrical conductor from the valve 34 through the wall 17 to the pump and timer unit 32.

It should be clear at this time that a liquid dispenser system for dispensing a cleaning or disinfecting liquid to a remote bathroom fixture has been provided as wall as a process for installing and operating the liquid dispenser system of the cleaning fluid and which is hidden away to avoid any unattractive features being visible to the eye. However, the present invention should not be considered as limited to the forms shown which are to be considered illustrative rather than restrictive.

I claim:

1. A liquid dispenser system for dispensing a liquid to a remote bathroom fixture comprising:

a bathroom wall unit attached in a bathroom wall;

an access cover covering said bathroom wall unit;

a liquid storage container located in said wall storage unit;

an electrically operated pump located in said bathroom wall storage unit and operatively connected to said liquid container for pumping the liquid from said container;

a conduit connected from said electric pump to said bathroom fixture for delivering liquid from said liquid storage container to the bathroom fixture;

a pump actuating switch electrically connected to said pump by an electric conductor for actuating said pump remotely to thereby pump liquid from said liquid storage container to the remote bathroom fixture.

2. A liquid dispenser system for dispensing a liquid to a remote bathroom fixture in accordance with claim 1 in which said access panel is a hinged door panel.

3. A liquid dispenser system for dispensing a liquid to a remote bathroom fixture in accordance with claim 1 in which said access panel is a hinged mirror panel.

4. A liquid dispenser system for dispensing a liquid to a remote bathroom fixture in accordance with claim 1 in which said pump actuating switch is a float actuated switch located in a toilet tank.

5. A liquid dispenser system for dispensing a liquid to a remote bathroom fixture in accordance with claim 4 in which said pump actuated float switch has a float member having a magnet attached thereto for actuating a magnetic relay when said float drops upon the lowering of the water in the toilet tank upon flushing the toilet.

6. A liquid dispenser system for dispensing a liquid to a remote bathroom fixture in accordance with claim 4 in which said pump actuating switch has attachment means for attaching said pump actuating switch to the side of a toilet tank.

7. A liquid dispenser system for dispensing a liquid to a remote bathroom fixture in accordance with claim 1 in which said pump includes a pump timer actuated by said pump actuated switch to time the pumping of liquid from said container.

8. A process for dispensing a liquid to a bathroom fixture comprising the steps of:

selecting a bathroom wall storage unit having an access cover and an electric pump therein;

attaching said bathroom wall storage unit in a bathroom wall;

placing a liquid storage container in said bathroom wall storage unit behind said access cover;

connecting said liquid storage container to said electric pump located in said wall storage area for pumping the liquid from said container;

connecting a conduit from said pump through a bathroom wall and to said bathroom fixture for delivering liquid from said liquid storage container to the bathroom fixture;

selecting a pump actuating switch;

positioning said selected pump actuated switch adjacent said bathroom fixture;

connecting an electrical conductor from said pump actuating switch through a bathroom wall to said electric pump for actuating said pump remotely to thereby pump liquid from said liquid storage container to the remote bathroom fixture.

9. A process for dispensing a liquid to a bathroom fixture in accordance with claim 8 including the step of making said access cover a hinged panel access cover.

10. A process for dispensing a liquid to a bathroom fixture in accordance with claim 8 including the step of making said access cover a hinged mirrored panel access cover.

11. A process for dispensing a liquid to a bathroom fixture in accordance with claim 8 in which the step of selecting a pump actuating switch includes selecting a float switch for positioning in a toilet tank.

12. A process for dispensing a liquid to a bathroom fixture in accordance with claim 11 in which the step of selecting said pump float actuating switch includes selecting a float switch having a float having a permanent magnet attached thereto for actuating a magnetic relay when said float drops upon the lowering of the water in said toilet tank when the toilet is flushed.

13. A process for dispensing a liquid to a bathroom fixture in accordance with claim 12 in which the step of positioning said float switch includes attaching said float switch to the inside of said toilet tank.

14. A process for dispensing a liquid to a bathroom fixture in accordance with claim 12 including the step of filling the selected liquid container with a toilet cleaning liquid.

* * * * *